US010787938B2

(12) United States Patent
Nishimoto et al.

(10) Patent No.: US 10,787,938 B2
(45) Date of Patent: Sep. 29, 2020

(54) ENGINE WITH VARIABLE VALVE TIMING MECHANISM

(71) Applicant: Mazda Motor Corporation, Aki-gun, Hiroshima (JP)

(72) Inventors: Toshiaki Nishimoto, Hiroshima (JP); Keiji Araki, Hatsukaichi (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 7 days.

(21) Appl. No.: 16/344,547

(22) PCT Filed: Oct. 28, 2016

(86) PCT No.: PCT/JP2016/082149

§ 371 (c)(1),
(2) Date: Apr. 24, 2019

(87) PCT Pub. No.: WO2018/078816

PCT Pub. Date: May 3, 2018

(65) Prior Publication Data

US 2019/0284969 A1 Sep. 19, 2019

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/022* (2013.01); *F01L 1/026* (2013.01); *F01L 1/2405* (2013.01); *F02B 63/06* (2013.01); *F02B 67/04* (2013.01); *F01L 1/185* (2013.01); *F01L 2001/0476* (2013.01); *F01L 2001/0537* (2013.01); *F01L 2001/3443* (2013.01); *F01L 2001/34473* (2013.01); *F01L 2001/34496* (2013.01); *F01L 2013/001* (2013.01); *F01L 2250/02* (2013.01);
(Continued)

(58) Field of Classification Search
CPC ..... F01L 1/3442; F01L 1/2405; F01L 1/022; F01L 1/026; F01L 2250/02; F01L 1/185; F01L 2001/0476; F01L 2001/3443; F01L 2001/0537; F01L 2001/34473; F01L 2001/34496; F01L 2800/05; F01L 2800/00; F01L 2810/02; F01L 2013/001; F01L 2105/00; F01L 2820/041; F02B 63/06; F02B 67/04
See application file for complete search history.

(56) References Cited

U.S. PATENT DOCUMENTS

2007/0068474 A1* 3/2007 Cinpinski ..... F01L 1/3442 123/90.17

FOREIGN PATENT DOCUMENTS

JP 2003161129 A 6/2003
JP 2007023953 A 2/2007
(Continued)

*Primary Examiner* — Xiao En Mo
(74) *Attorney, Agent, or Firm* — Alleman Hall Creasman & Tuttle LLP

(57) ABSTRACT

The number of advance chambers is larger than the number of retard chambers in an intake variable valve timing (VVT), whereas the number of retard chambers is larger than the number of advance chambers in an exhaust VVT. Accordingly, with limitation of an oil pressure that can be used by the VVTs, a pumping loss in a transition period in which a valve overlap amount is changed by advancing or retarding a valve timing can be reduced.

4 Claims, 12 Drawing Sheets

(51) Int. Cl.

| | |
|---|---|
| ***F02B 63/06*** | (2006.01) |
| ***F02B 67/04*** | (2006.01) |
| ***F01L 1/24*** | (2006.01) |
| ***F01L 1/02*** | (2006.01) |
| *F01L 1/18* | (2006.01) |
| *F01L 1/047* | (2006.01) |
| *F01L 1/053* | (2006.01) |
| *F01L 13/00* | (2006.01) |

(52) U.S. Cl.
CPC ..... *F01L 2305/00* (2020.05); *F01L 2800/00* (2013.01); *F01L 2800/05* (2013.01); *F01L 2810/02* (2013.01); *F01L 2820/041* (2013.01)

(56) References Cited

FOREIGN PATENT DOCUMENTS

| | | | |
|---|---|---|---|
| JP | 2007239693 | A | 9/2007 |
| JP | 2010169009 | A | 8/2010 |
| JP | 2013217198 | A | 10/2013 |
| JP | 2015194132 | A | 11/2015 |
| JP | 2016166570 | A | 9/2016 |

* cited by examiner

ENGINE WITH VARIABLE VALVE TIMING MECHANISM

TECHNICAL FIELD

The present invention relates to an engine with a variable valve timing mechanism.

BACKGROUND ART

A known variable valve timing mechanism (hereinafter referred to as a "VVT") of an engine is a hydraulic VVT described in Patent Document 1. This VVT includes advance chambers and retard chambers defined by a housing that rotates in cooperation with a crank shaft of the engine and a vane body that rotates together with the cam shaft. When an oil pressure is supplied to the advance chambers, a phase angle of the cam shaft with respect to the crank shaft, that is, a valve timing, changes in an advancing direction, whereas when an oil pressure is supplied to the retard chambers, the valve timing changes in a retarding direction. In the engine described in Patent Document 1, hydraulic VVTs are disposed in both an intake side and an exhaust side.

To change the phase angle of the cam shaft in the advancing direction, it is necessary to rotate the cam shaft against a biasing force of a valve spring. Thus, in the hydraulic VVTs, the number of advance chambers is generally larger than the number of retard chambers.

CITATION LIST

Patent Document

PATENT DOCUMENT 1: Japanese Patent Application Publication No. 2015-194132

SUMMARY OF THE INVENTION

Technical Problem

It is known that in a low-load to intermediate-load operating range of an engine, when a valve overlap amount in which an open period of an intake valve and an open period of an exhaust valve overlap each other is increased, a pumping loss decreases, and fuel efficiency of the engine is enhanced.

On the other hand, in view of enhancement of fuel efficiency of the engine, a discharge oil pressure of an oil pump driven by the engine is set as low as possible. In this case, an oil pressure usable by the VVT is restricted to a low range, and thus, the operating speed of the VVT is also restricted depending on the level of the usable oil pressure. Alternatively, in the case of including a hydraulic valve stop mechanism that performs a reduced-cylinder operation of an engine by stopping intake valves and/or exhaust valves of some cylinders of the engine under an oil pressure by the oil pump, the operating speed of the VVT is restricted in the reduced-cylinder operation in such a manner that an oil pressure supplied from the oil pump to the valve stop mechanism does not decrease below an oil pressure necessary for maintaining the valve stop state.

In view of this, in a case where the operating state with a small valve overlap amount transitions to an operating state with a large valve overlap amount by retarding the valve timings of the intake valve and the exhaust valve with an increase in an engine load, for example, it is difficult to increase the valve overlap amount in this transition period. That is, since restriction of the operating speed makes it difficult to increase the retarding speed in the exhaust side relative to the retarding speed in the intake side, the valve timings of the intake side and the exhaust side are retarded with a small valve overlap amount. Thus, in the transition period, a pumping loss does not decrease, and a fuel efficiency deteriorates. In addition, restriction of the operating speed requires a time for changing the valve timings, and thus, a pumping loss further deteriorates fuel efficiency.

It is therefore an object of the present invention to reduce a pumping loss in a transition period in which a valve overlap amount is changed by advancement or retardation of a valve timing under restriction of an oil pressure usable by a VVT.

Solution to the Problem

According to the present invention, advance chambers and retard chambers of an intake-side VVT and an exhaust-side VVT are configured such that a pumping loss in the transition period decreases.

A VVT-equipped engine disclosed here includes: an intake VVT serving as a variable valve timing mechanism that changes a phase angle of an intake cam shaft with respect to a crank shaft and; an exhaust VVT serving as a variable valve timing mechanism that changes a phase angle of an exhaust cam shaft with respect to the crank shaft, wherein each of the intake VVT and the exhaust VVT is a hydraulic VVT including advance chambers for changing the phase angle in an advancing direction by supply of an oil pressure and retard chambers for changing the phase angle in a retarding direction by supply of an oil pressure, each of the advance chambers and the retard chambers is defined by a housing configured to rotate in cooperation with the crank shaft and a vane body configured to rotate together with the cam shaft, and the number of the advance chambers is larger than or equal to the number of the retard chambers in the intake VVT and the number of the retard chambers is larger than or equal to the number of the advance chambers in the exhaust VVT or the number of the advance chambers is larger than the number of the retard chambers in the intake VVT and the number of the retard chambers is larger than or equal to the number of the advance chambers in the exhaust VVT.

The intake cam shaft and the exhaust cam shaft lift the intake valve and the exhaust valve by cams against biasing forces of valve springs by rotating in the advancing direction. Thus, the biasing forces of the valve springs are exerted on the cam shafts in the retarding direction. Thus, a driving force necessary for rotating the cam shafts in the retarding direction is smaller than that in the advancing direction. That is, as long as oil pressures applied to the vane bodies of the VVTs are the same, the retarding speed is higher than the advancing speed.

The configuration of the VVT-equipped engine "the number of the advance chambers is larger than or equal to the number of the retard chambers in the intake VVT and the number of the retard chambers is larger than the number of the advance chambers in the exhaust VVT" means that the advancing speed is not retarded in the intake side and the retarding speed is further increased in the exhaust side.

In this case, regarding the advancing speed, since the number of the advance chambers is larger than or equal to the number of the retard chambers in the intake VVT and the number of the advance chambers is smaller than the number of the retard chambers in the exhaust VVT, the advancing speed in the intake side can be made higher than the advancing speed in the exhaust side. Accordingly, in a transition period in which the opening and closing timings (valve timings) of the intake valve and the exhaust valve are advanced to shift the valve overlap amount from a large state to a small state, the advancing speed in the intake side is made higher than the advancing speed in the exhaust side so that the state with a large valve overlap amount can be continued for a while. Consequently, an increase in a pumping loss is suppressed so that fuel efficiency can be enhanced.

On the other hand, regarding the retarding speed, in the exhaust VVT, the exhaust cam shaft is biased to rotate in the retarding direction by the valve spring, and in addition, the number of the retard chambers is larger than the number of the advance chambers. Thus, the retarding speed can be further increased. Accordingly, in a transition period in which the valve timings of the intake valve and the exhaust valve are retarded to shift the valve overlap amount from a small state to a large state, the retarding speed in the exhaust side is made higher than the retarding speed in the intake side so that the valve overlap amount can be quickly increased. As a result, a pumping loss can be reduced so that fuel efficiency can be enhanced.

Next, a case where "the number of the advance chambers is larger than the number of the retard chambers in the intake VVT and the number of the retard chambers is larger than or equal to the number of the advance chambers in the exhaust VVT" in the VVT-equipped engine will be described.

Regarding the advancing speed, in this case, since the number of the advance chambers is larger than the number of the retard chambers in intake VVT and the number of the advance chambers is larger than or equal to the number of the retard chambers in the exhaust VVT, the advancing speed in the intake side can be made higher than the advancing speed in the exhaust side, in a manner similar to the former case. Accordingly, in a transition period in which the opening and closing timings of the intake valve and the exhaust valve are advanced to shift the valve overlap amount from a large state to a small state, the state with a large valve overlap amount can be continued for a while, and thereby, an increase in a pumping loss can be suppressed so that fuel efficiency can be enhanced.

Regarding the retarding speed, this case includes a case where the number of the retard chambers is equal to the number of the advance chambers in the exhaust VVT. In this case, however, since a biasing force of the valve spring is exerted on the exhaust cam shaft in the retarding direction as described above, in a transition period in which the opening and closing timings of the intake valve and the exhaust valve are retarded to shift the valve overlap amount from a small state to a large state, the retarding speed in the exhaust side can be made higher than the retarding speed in the intake side so that the valve overlap amount can be increased quickly. As a result, a pumping loss can be reduced so that fuel efficiency can be enhanced.

In one aspect, the engine may include a transfer unit that drives the housing of the intake VVT and the housing of the exhaust VVT such that the housing of the intake VVT and the housing of the exhaust VVT rotate in opposite direction by the crank shaft, wherein the number of the advance chambers in the intake VVT may be equal to the number of the retard chambers in the exhaust VVT, and the number of the retard chambers in the intake VVT may be equal to the number of the advance chambers in the exhaust VVT.

The expression in which the housing of the intake VVT and the housing of the exhaust VVT rotate in opposite directions means the following configuration. In a configuration employing, as an intake VVT, a hydraulic VVT including a first operating chamber for pivoting a vane body in one direction and a second operating chamber for pivoting the vane body in the other direction, the first operating chamber serves as an advance chamber and the second operating chamber serves as a retard chamber, whereas in a configuration employing the hydraulic VVT as an exhaust VVT, the first operating chamber serves as a retard chamber and the second operating chamber serves as an advance chamber, in a manner opposite to the case of the intake VVT.

In view of this, in this embodiment, the housing of the intake VVT and the housing of the exhaust VVT are rotated in opposite directions under conditions where the number of the advance chambers in the intake VVT is equal to the number of the retard chambers in the exhaust VVT, and the number of the retard chambers in the intake VVT is equal to the number of the advance chambers in the exhaust VVT. Thus, the hydraulic VVT with the same configuration can be employed for both of the intake VVT and the exhaust VVT. Accordingly, it is unnecessary to provide a hydraulic VVT for each of the intake VVT and the exhaust VVT, which is advantageous in reducing manufacturing costs.

In one aspect, the engine may include a high-pressure fuel pump that serves as an auxiliary machine of the engine and supplies fuel to a combustion chamber of the engine, the number of the advance chambers may be larger than the number of the retard chambers in the intake VVT, and the intake cam shaft may include a cam portion that drives the fuel pump.

In a case where cam driving of the fuel pump is performed by using the cam shaft, the cam shaft is under a heavy rotation load in the advancing direction. On the other hand, in the intake VVT, since the number of advance chambers is larger than the number of retard chambers, the rotation load on the intake cam shaft in the advancing direction has a margin, as compared to the exhaust VVT. In view of this, in this embodiment, cam driving of the fuel pump is performed by using the intake cam shaft. Accordingly, the fuel pump can be easily operated with stability without hindering a change of opening and closing of the intake valve and the timings of opening and closing the intake valve. In addition, the fuel pump can be easily disposed in the intake side of the engine, which is advantageous in safety.

Advantages of Invention

According to the present invention, in a case where the number of advance chambers is larger than or equal to the number of retard chambers in the intake VVT, the number of retard chambers is larger than the number of advance chambers in the exhaust VVT, and in a case where the number of advance chambers is larger than the number of retard chambers in the intake VVT, the number of retard chambers is larger than or equal to the number of advance chambers in the exhaust VVT. Thus, in a transition period in which the opening and closing timings of the intake valve and the exhaust valve are advanced to shift the valve overlap amount from a large state to a small state, a state with a large valve overlap amount can be continued for a while, and in a transition period in which the opening and closing timings of the intake valve and the exhaust valve are retarded to shift the valve overlap amount from a small state to a large state, the valve overlap amount can be increased quickly. As a result, in a situation where oil pressures that can be used by the intake VVT and the exhaust VVT are restricted, a pumping loss in a transition period in which the valve overlap amount is changed by advancing or retarding the opening/closing timing can be reduced, which is advantageous for enhancing fuel efficiency.

DESCRIPTION OF EMBODIMENTS

Embodiments for carrying out the present invention will be described with reference to the drawings. The following embodiments are merely preferred examples in nature, and are not intended to limit the invention, applications, and use of the applications.

Engine Configuration

Figure 1:
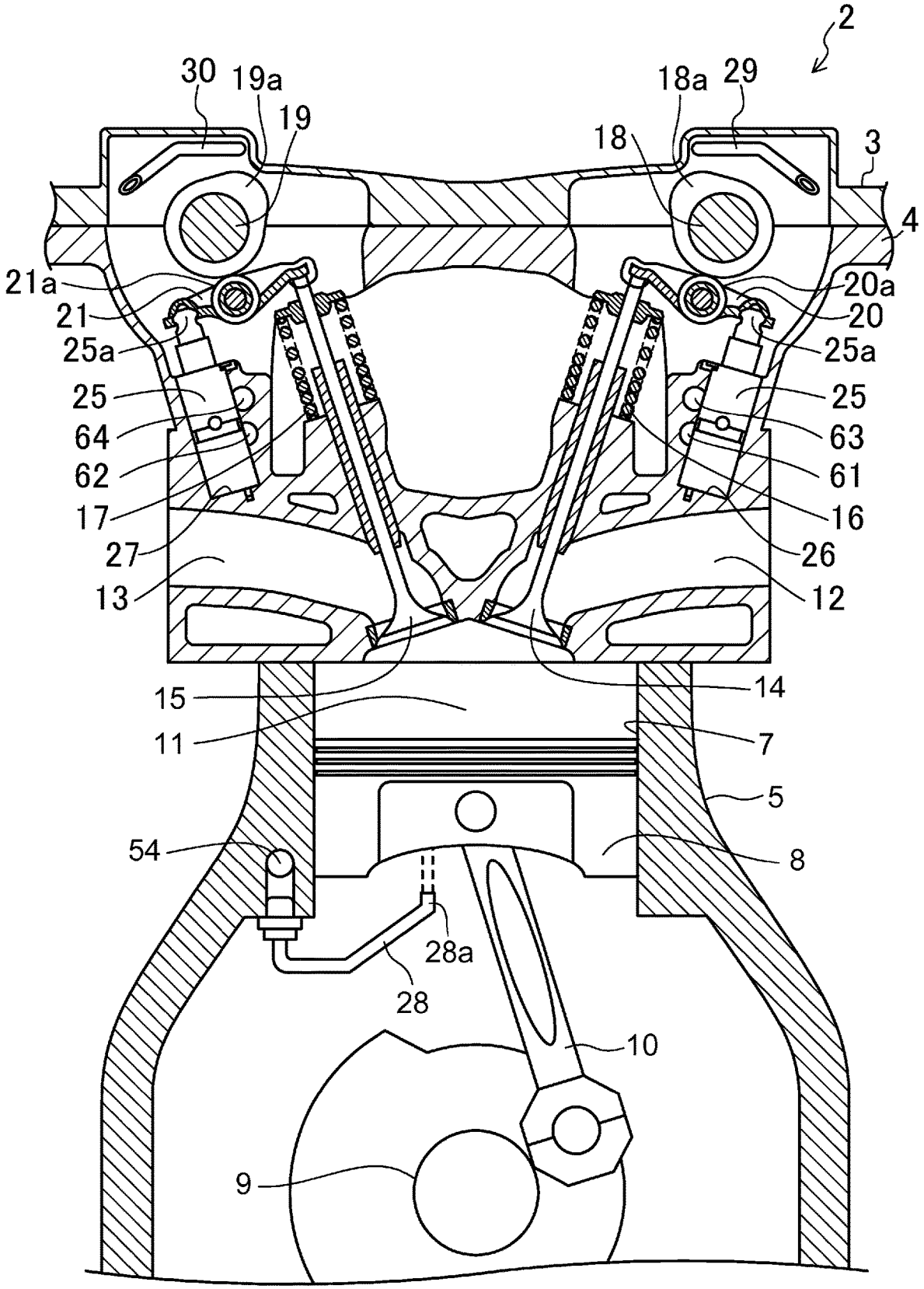
FIG. 1 A cross-sectional view illustrating a schematic configuration of a VVT-equipped engine.

The engine 2 illustrated in FIG. 1 is, for example, an inline four-cylinder gasoline engine in which first through fourth cylinders are arranged in series in a direction perpendicular to the drawing sheet of FIG. 1, and is mounted on a vehicle such as an automobile.

In the engine 2, a head cover 3, a cylinder head 4, a cylinder block 5, a crank case (not shown), and an oil pan 6 (see FIG. 10) are coupled vertically. A piston 8 slidable in each of four cylinder bores 7 formed in the cylinder block 5 is coupled to a crank shaft 9 rotatably supported on the crank case by a connecting rod 10. The cylinder bore 7 in the cylinder block 5, the piston 8, and the cylinder head 4 form a combustion chamber 11 for each cylinder.

The cylinder head 4 has an intake port 12 and an exhaust port 13 each communicating with the combustion chamber 11. The intake port 12 and the exhaust port 13 are provided with an intake vale 14 and an exhaust valve 15 that open and close the intake port 12 and the exhaust port 13, respectively. The intake valve 14 and the exhaust valve 15 are biased in closing directions (upward in FIG. 1) by valve springs 16 and 17, respectively. Cam portions 18*a* and 19*a* disposed on outer peripheries of an intake cam shaft 18 and an exhaust cam shaft 19 push cam followers 20*a* and 21*a* rotatably disposed substantially on center portions of swing arms 20 and 21 downward. Accordingly, the swing arms 20 and 21 swing about vertexes of pivot mechanisms 25*a* each disposed at one end of each of the swing arms 20 and 21. In this manner, at the other end of each of the swing arms 20 and 21, the intake valve 14 and the exhaust valve 15 are opened while being pushed downward against biasing forces of the valve springs 16 and 17.

A known hydraulic lash adjuster 24 (hereinafter referred to as an HLA 24) that automatically adjusts a valve clearance to zero by an oil pressure is provided as pivot mechanisms (having a configuration similar to that of a pivot mechanism 25*a* of an HLA 25 described later) in the swing arms 20 and 21 of the second cylinder and the third cylinder located at a center portion in the cylinder line of the engine 2. The HLA 24 is shown only in FIG. 10.

The HLA 25 equipped with a valve stop mechanism (hereinafter referred to as a valve stop mechanism-equipped HLA 25) including the pivot mechanism 25*a* is provided on each of the swing arms 20 and 21 of the first cylinder and the fourth cylinder at the ends of the cylinder line of the engine 2. The pivot mechanism 25*a* of the valve stop mechanism-equipped HLA 25 is configured to automatically adjust a valve clearance to zero by an oil pressure in a manner similar to the HLA 24. In addition, the valve stop mechanism of the HLA 25 stops operations (i.e., stops open and close operations) of the intake and exhaust valves 14 and 15 of the first cylinder and the fourth cylinder in a reduced-cylinder operation in which operations of the first cylinder and the fourth cylinder as a part of all the cylinders of the engine 2 are suspended, and operates (i.e., performs open and close operations of) the intake and exhaust valves 14 and 15 of the first cylinder and the fourth cylinder in an all-cylinder operation in which all the cylinders (four cylinders) are operated. The intake and exhaust valves 14 and 15 of the second cylinder and the third cylinder operate in both the reduced-cylinder operation and the all-cylinder operation. The reduced-cylinder operation and the all-cylinder operation are switched to each other when necessary in accordance with the operating state of the engine 2.

Intake- and exhaust-side portions of the cylinder head 4 corresponding to the first and fourth cylinders respectively have attachment holes 26 and 27 for inserting and attaching lower end portions of the valve stop mechanism-equipped HLAs 25. Intake- and exhaust-side portions of the cylinder head 4 corresponding to the second cylinder and the third cylinder have attachment holes for inserting and attaching lower end portions of the HLAs 24. In addition, two oil passages 61 and 63 and two oil passages 62 and 64 are formed to pierce the cylinder head 4 and respectively communicate with the attachment holes 26 and 27 for the valve stop mechanism-equipped HLAs 25. An oil pressure (operating pressure) is supplied from the oil passages 61 and 62 to valve stop mechanisms 25*b* (see FIGS. 2A through 2C) in the valve stop mechanism-equipped HLAs 25 in a state where the valve stop mechanism-equipped HLAs 25 are fitted in the attachment holes 26 and 27. On the other hand, an oil pressure for enabling the pivot mechanisms 25*a* of the valve stop mechanism-equipped HLAs 25 to automatically adjust valve clearances to zero is supplied from the oil passages 63 and 64. Only the oil passages 63 and 64 communicate with the attachment holes for the HLAs 24. The oil passages 61 through 64 will be described in detail later with reference to FIG. 10.

The cylinder block 5 includes a main gallery 54 extending along the cylinder line in a side wall at an exhaust side of the cylinder bores 7. Near a lower side of the main gallery 54, oil jets 28 that are used for cooling the pistons and communicate with the main gallery 54 are disposed. Each oil jet 28 has a nozzle portion 28*a* disposed under the piston 8, and injects oil (engine oil) toward the back side of a vertex portion of the piston 8 from the nozzle portion 28*a*.

Oil showers 29 and 30 constituted by pipes are disposed above the cam shafts 18 and 19, respectively. Lubricating oil is dropped from the oil showers 29 and 30 onto the underlying cam portions 18*a* and 19*a* of the cam shafts 18 and 19 and further underlying contact portions between the swing arms 20 and 21 and the cam followers 20*a* and 21*a*.

Here, the valve stop mechanism 25*b* will be described with reference to FIGS. 2A to 2C. The valve stop mechanism 25*b* stops an operation of at least one of the intake and exhaust valves 14 and 15 (both of the valves in this embodiment) of the first cylinder and the fourth cylinder that are a part of all the cylinders of the engine 2. In a reduced-cylinder the of the engine 2, the valve stop mechanisms 25*b* stop opening and closing operations of the intake and exhaust valves 14 and 15 of the first cylinder and the fourth cylinder. In an all-cylinder operation of the engine 2, stopping of operations of the valves by the valve stop mechanisms 25*b* is canceled, and opening and closing operations of the intake and exhaust valve 14 and 15 of the first cylinder and the fourth cylinder are performed.

Figure 2A:
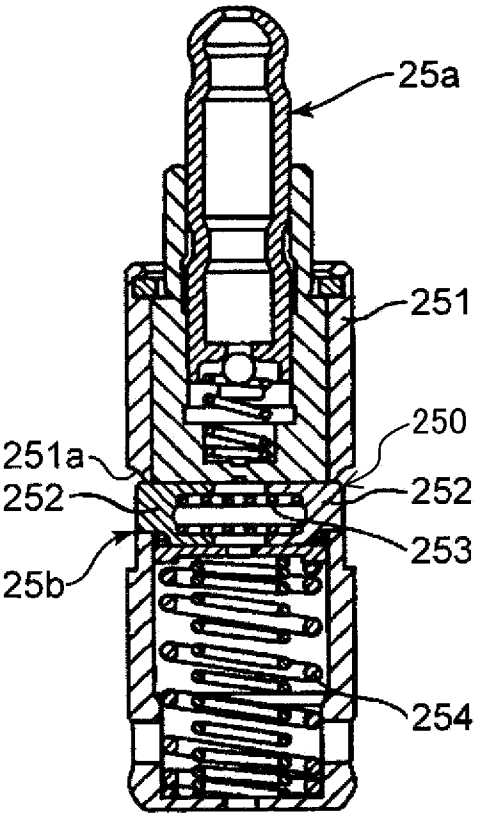
FIGS. 2A-2C Cross-sectional views illustrating a configuration and operating states of a valve stop mechanism.

As illustrated in FIG. 2A, each of the valve stop mechanisms 25*b* includes a lock mechanism 250 that locks an operation of the pivot mechanism 25*a*. The lock mechanism 250 includes a pair of lock pins 252 (lock members). The lock pins 252 are disposed to be inserted and extracted into/from two through holes 251*a* that are radially opposed to each other in a side surface of a bottomed outer cylinder 251 that houses the pivot mechanism 25*a* such that the pivot mechanism 25*a* is axially slidable. The pair of lock pins 252 is biased radially outward by a spring 253. A lost motion spring 254 that presses and biases the pivot mechanism 25*a* upward from the outer cylinder 251 is disposed between the inner bottom of the outer cylinder 251 and the bottom of the pivot mechanism 25*a*.

In a case where the lock pins 252 are fitted in the through holes 251*a* of the outer cylinder 251, the pivot mechanism 25*a* located above the lock pins 252 is fixed while projecting upward. In this case, the vertex portion of the pivot mechanism 25*a* serves as a fulcrum of swing of each of the swing arms 20 and 21, and thus, when the cam portions 18*a* and 19*a* push the cam followers 20*a* and 21*a* downward with rotation of the cam shafts 18 and 19, the intake and exhaust valves 14 and 15 are pushed downward against biasing forces of the valve springs 16 and 17 to be opened. In this manner, the lock pins 252 cause the valve stop mechanism 25*b* to be fitted in the through holes 251*a* in the first cylinder and the fourth cylinder so that the engine 2 can thereby perform an all-cylinder operation.

Figure 2B:
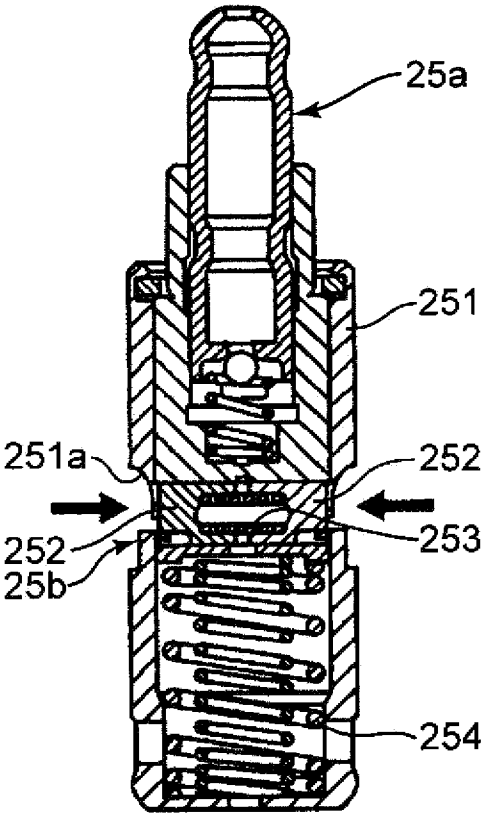
Figure 2C:
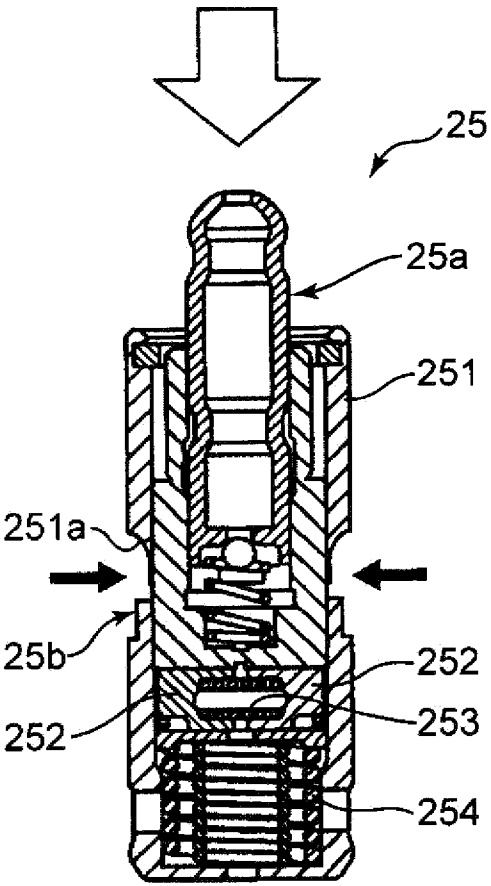

On the other hand, as illustrated in FIGS. 2B and 2C, when the outer end surfaces of the lock pins 252 are pushed by an operating oil pressure, the lock pins 252 move rearward toward the radially inside of the outer cylinder 251 against a biasing force of the spring 253 such that the lock pins 252 approach each other. Consequently, the lock pins 252 are released from the through holes 251*a* of the outer cylinder 251, and thus, the pivot mechanism 25*a* located above the lock pins 252 moves downward to be axially under the outer cylinder 251 together with the lock pins 252 so that the valves come to be in a valve stop state.

That is, the valve springs 16 and 17 that bias the intake and exhaust valves 14 and 15 upward are configured to generate biasing forces greater than that of the lost motion spring 254 that biases the pivot mechanism 25*a* upward. Accordingly, when the cam portions 18*a* and 19*a* respectively push the cam followers 20*a* and 21*a* downward with rotation of the cam shafts 18 and 19, the vertex portions of the intake and exhaust valves 14 and 15 serve as fulcrums of swing of the swing arms 20 and 21. Consequently, with the intake and exhaust valves 14 and 15 closed, the pivot mechanisms 25*a* are pushed downward against biasing forces of the lost motion springs 254. As a result, the lock pins 252 are released from the through holes 251*a* by an operating oil pressure so that a reduced-cylinder operation can be performed.

Intake VVT and Exhaust VVT

Figure 3:
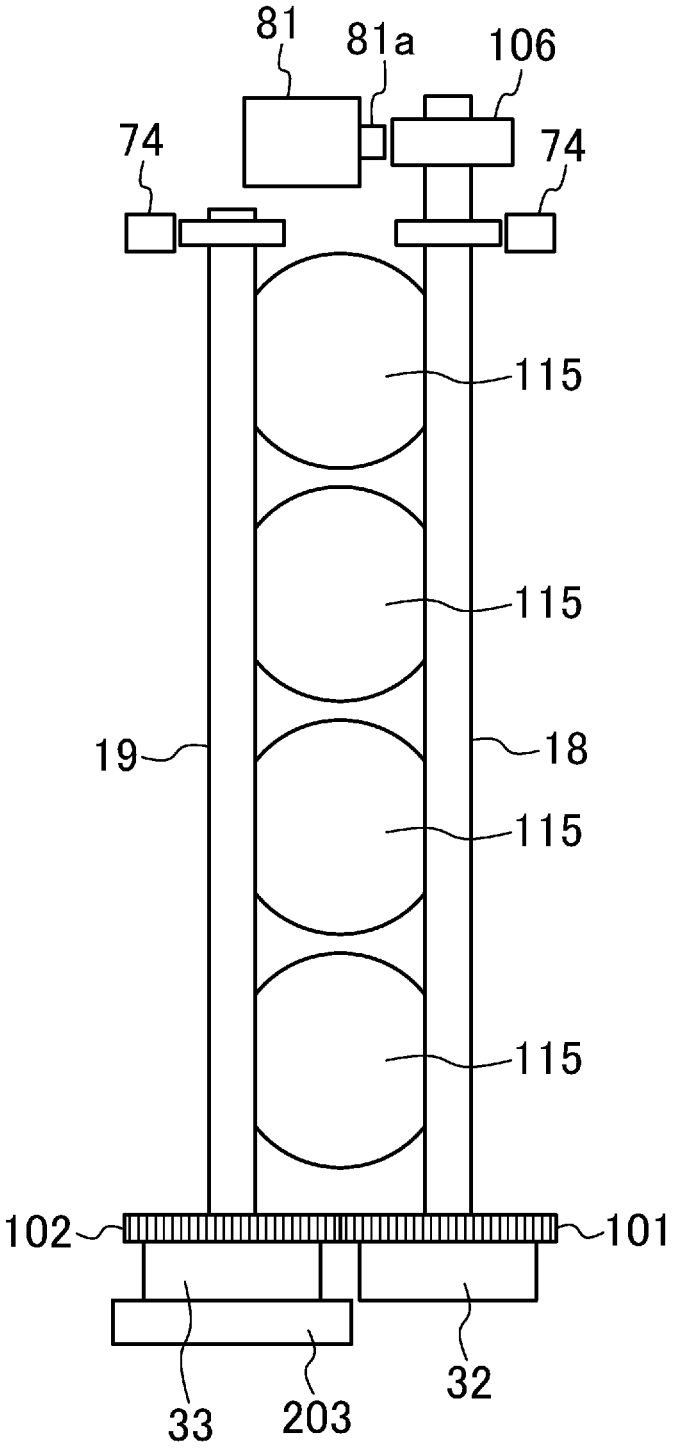
FIG. 3 A plan view schematically illustrating an arrangement of an engine device concerning a VVT.

As illustrated in FIG. 3, the intake cam shaft 18 and the exhaust cam shaft 19 extend along a line of cylinders 115. An intake VVT 32 is disposed at one end of the intake cam shaft 18, and an exhaust VVT 33 is disposed at one end of the exhaust cam shaft 19. Gears 101 and 102 that mesh with each other are fixed to housings 201 (see FIGS. 5, 6, 8, and 9) described later of the intake VVT 32 and the exhaust VVT 33. The meshing of the gears 101 and 102 causes the intake VVT 32 and the exhaust VVT 33 to rotate in opposite directions together with the cam shafts 18 and 19.

A cam angle sensor 74 that detects rotation phases of the cam shafts 18 and 19 and, based on the cam angles thereof, detects phase angles of the VVTs 32 and 33 are disposed near the other end of each of the intake cam shaft 18 and the exhaust cam shaft 19. In addition, a pump cam 106 for driving a high-pressure fuel pump 81 that supplies fuel to the combustion chamber 11 of the engine 2 is disposed at the other end of the intake cam shaft 18. The pump cam 106 drives a plunger 81*a* of the fuel pump 81, and the fuel pump 81 supplies high-pressure fuel to a fuel injection valve that supplies fuel to the combustion chamber 11 of the engine 2.

Figure 4:
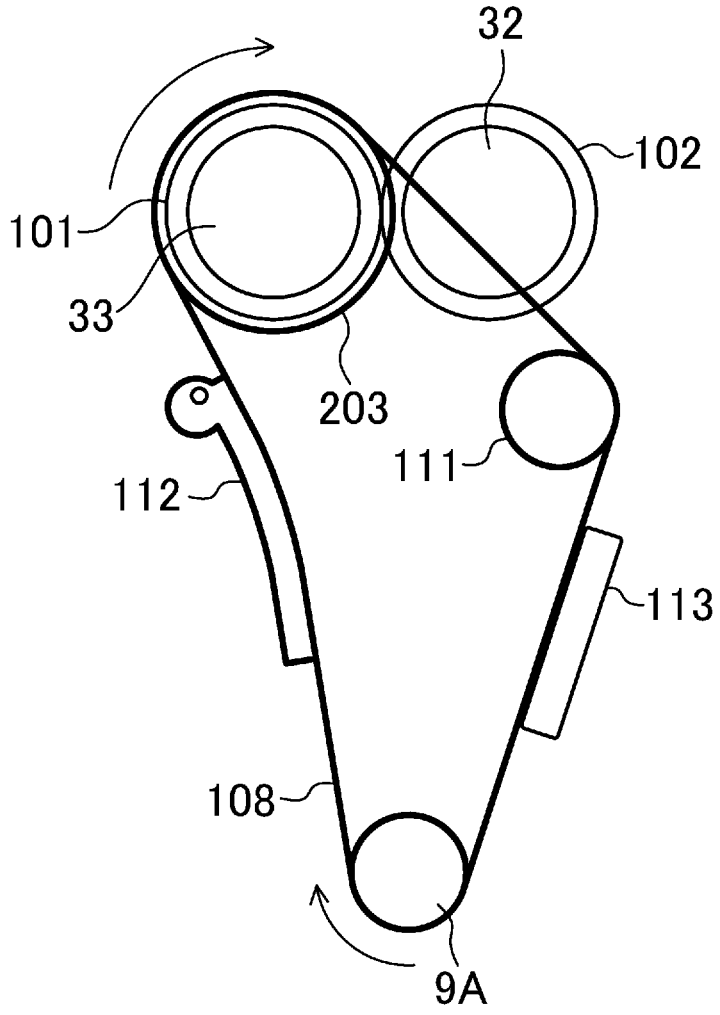
FIG. 4 A side view schematically illustrating a driving system of an intake and exhaust VVTs and intake and exhaust cams.

Then, as illustrated in FIG. 4, a timing chain 108 is wound around a cam pulley (sprocket) 203 and a crank shaft pulley (sprocket) 9A fixed to the housing 201 of the exhaust VVT 33. An intermediate sprocket 111, a hydraulic chain tensioner 112, and a chain guide 113 are disposed between the crank shaft pulley 9A and the cam pulley 203.

The gears 101 and 102 and the timing chain 108 constitute a transfer unit that drives the housing 201 of the intake VVT 32 and the housing 201 of the exhaust VVT 33 to rotate in opposite directions by the crank shaft 9.

Configuration of Exhaust VVT

Figure 5:
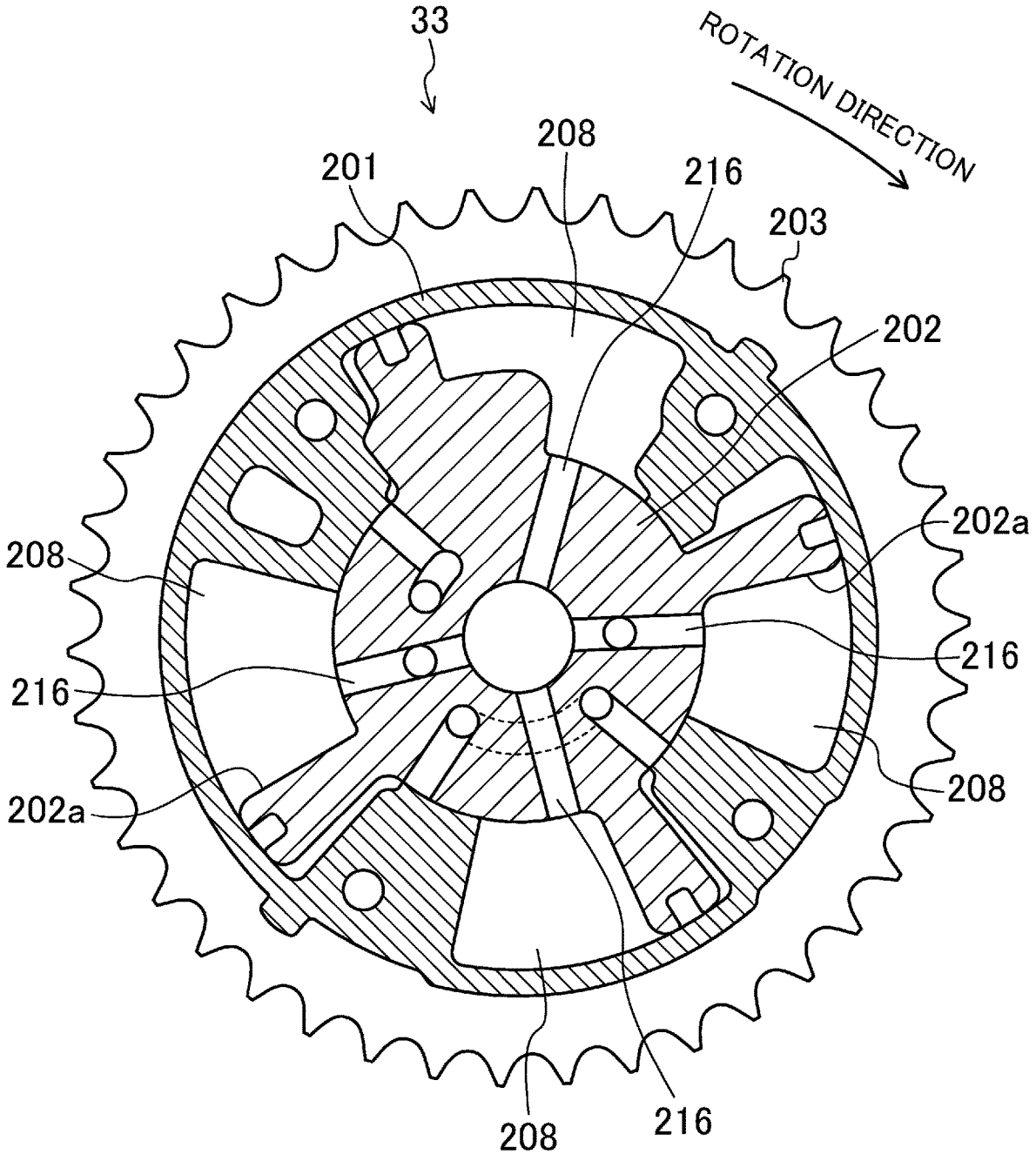
FIG. 5 A lateral cross-sectional view of the exhaust VVT in a most retarded state.
Figure 6:
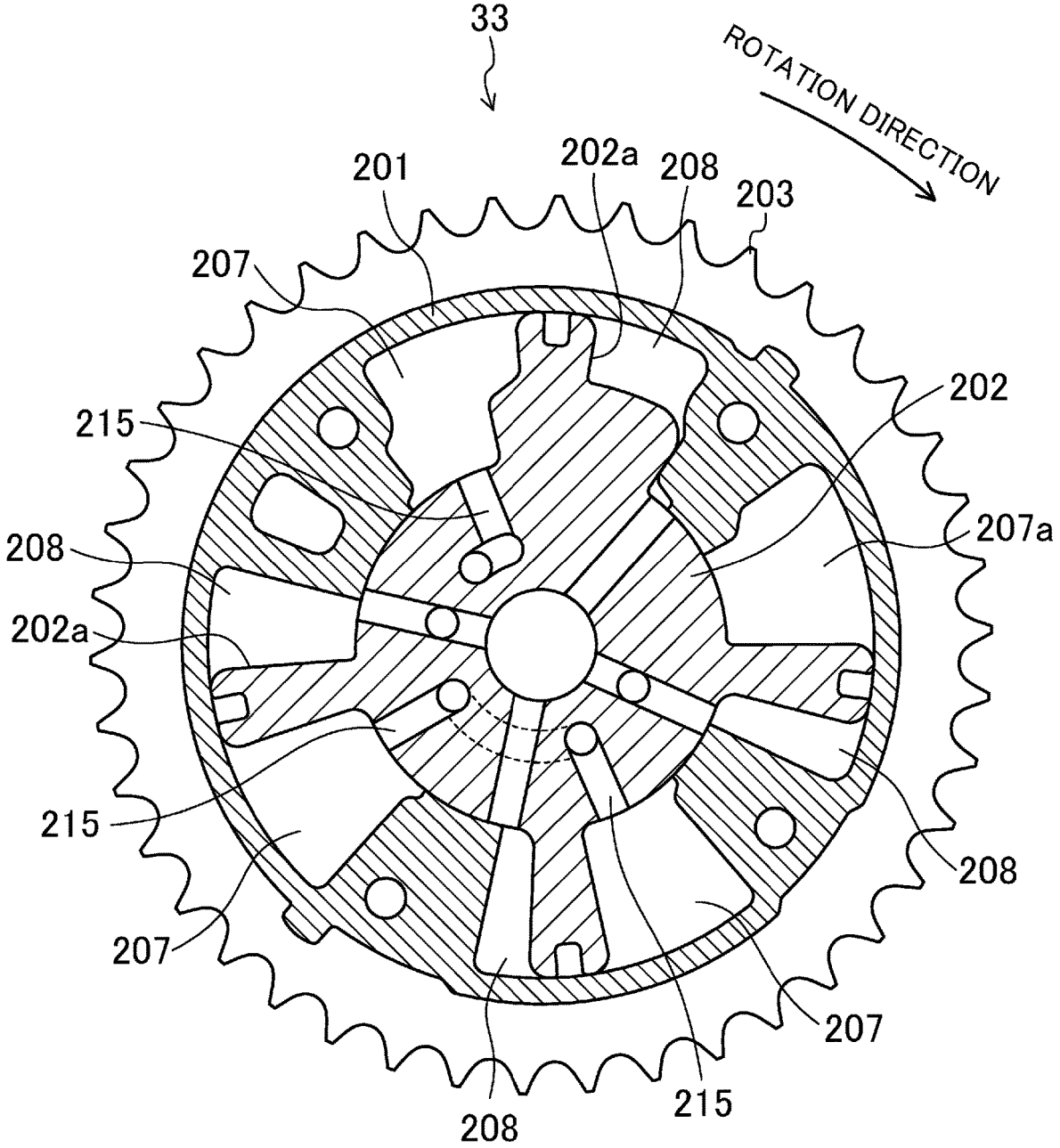
FIG. 6 A lateral cross-sectional view of the exhaust VVT in a most advanced state.
Figure 7:
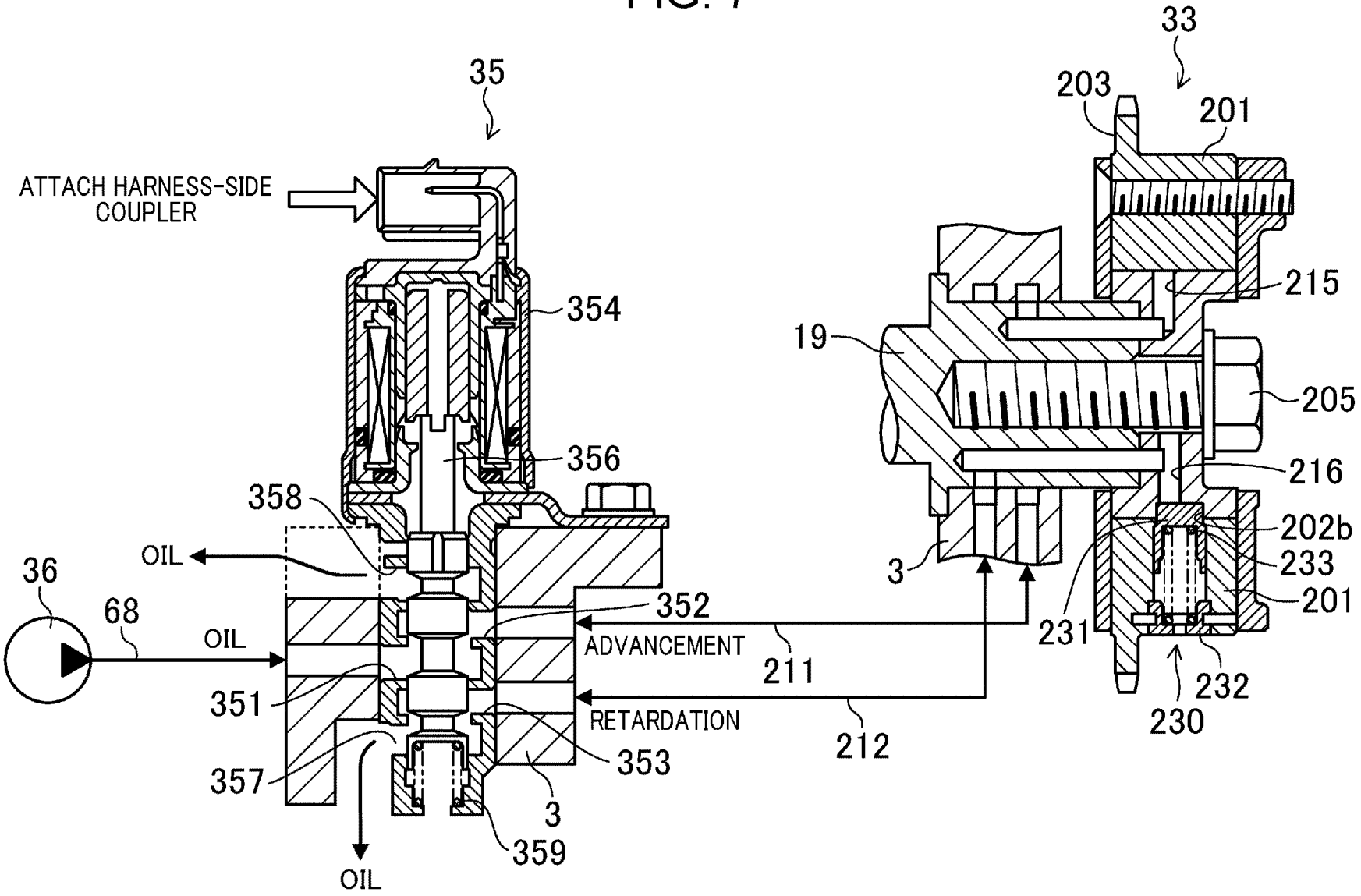
FIG. 7 A cross-sectional view illustrating a relationship between the exhaust VVT and an oil pressure control valve.

First, the exhaust VVT will be described. FIGS. 5 through 7 illustrate the exhaust VVT 33. FIG. 7 also illustrates an exhaust-side oil pressure control valve 35 that controls an operation of the exhaust VVT 33 by an oil pressure.

The exhaust VVT 33 is operated by an oil pressure, and includes the substantially annular housing 201 and a vane body 202 housed in the housing 201. The housing 201 is coupled to be rotatable together with a cam pulley 203 that rotates in synchronization with the crank shaft 9, and rotates in cooperation with the crank shaft 9. The vane body 202 includes a plurality of vanes 202*a*, and as illustrated in FIG. 7, is coupled to the exhaust cam shaft 19 by a fastening bolt 205 such that the vane body 202 is rotatable together with the exhaust cam shaft 19.

In the housing 201, a plurality of advance chambers 207 and a plurality of retard chambers 208 are defined by the housing 201 and the vane body 202. As illustrated in FIG. 7, the advance chambers 207 and the retard chambers 208 are connected to an exhaust-side oil pressure control valve (first direction switching valve) 35 through an advance-side oil passage 211 and a retard-side oil passage 212, respectively. The exhaust-side oil pressure control valve 35 is connected to a variable displacement oil pump 36. In the cam shaft 19 and the vane body 202, advance-side oil passages 215 and retard-side oil passages 216 constituting parts of the advance-side oil passage 211 and the retard-side oil passage 212 are formed.

FIG. 5 illustrates a state where each of the vanes 202*a* is held in a most retarded position with respect to the cam pulley 203, that is, the crank shaft 9, by oil supplied through the retard-side oil passages 216. In contrast, FIG. 6 illustrates a state where each of the vanes 202*a* is held in a most advanced position with respect to the cam pulley 203 by oil supplied through the advance-side oil passages 215.

The advance-side oil passages 215 extend radially from a vicinity of the center of the vane body 202 and are connected to the advance chambers 207. The retard-side oil passages 216 extend radially from a vicinity of the center of the vane body 202 and are connected to the retard chamber 208.

A chamber 207*a* illustrated in FIG. 6 does not communicate with the advance-side oil passages 215, and no oil is supplied. Thus, no rotation torque is generated on the vanes 202*a*. That is, the chamber 207*a* does not constitute an advance chamber. Thus, the number of advance chambers 207 is smaller than that of retard chambers 208 by one. The exhaust VVT 33 according to this embodiment includes three advance chambers 207 and four retard chambers 208.

As illustrated in FIG. 7, the exhaust VVT 33 includes a lock mechanism 230 for locking an operation of the exhaust VVT 33. FIGS. 5 and 6 do not show the lock mechanism 230. The lock mechanism 230 includes a lock pin 231 for locking a phase angle of the exhaust cam shaft 19 with respect to the crank shaft 9 at an intermediate phase angle between a most advanced angle and a most retarded angle.

The lock pin 231 is slidable in the radial direction of the housing 201. A spring holder 232 is fixed to a portion of the housing 201 radially outside the lock pin 231. A lock pin biasing spring 233 that biases the lock pin 231 radially inward of the housing 201 is disposed between the spring holder 232 and the lock pin 231. While the fitting recess 202*b* formed in a portion of the outer peripheral surface of the vane body 202 where no vanes 202*a* are formed is at a position facing the lock pin 231, the lock pin biasing spring 233 causes the lock pin 231 to be fitted in the fitting recess 202*b*, that is, to be in a locked state. Accordingly, the vane body 202 is fixed to the housing 201, and the phase angle of the exhaust cam shaft 19 with respect to the crank shaft 9 is locked.

As illustrated in FIG. 7, the exhaust-side oil pressure control valve 35 is a solenoid valve having three ports and three positions, a supply port 351 is connected to the oil pump 36, and output ports 352 and 353 are connected to the advance-side oil passages 215 and the retard-side oil passages 216, respectively. In FIG. 7, reference numeral 354 denotes a solenoid that exerts an electromagnetic force on a spool 356.

FIG. 7 illustrates a state where the supply port 351 communicates with the output port 352. Oil in an amount in accordance with the communication degree of the supply port 351 is supplied to the advance chambers 207 of the VVT 33. Accordingly, the vane body 202 rotates in the advancing direction so that the volume of the retard chambers 208 is reduced. With this volume reduction, oil discharged from the retard chambers 208 is drained from the output port 353 to the oil pan 6 through a drain port 357.

When the spool 356 moves forward (moves downward in FIG. 7) against a biasing force of the return spring 359 to reach a neutral position in which both the output ports 352 and 353 are closed, oil supply to the advance chambers 207 and the retard chambers 208 are blocked.

When the spool 356 further moves forward against a biasing force of the return spring 359, the supply port 351 communicates with the output port 353. Accordingly, oil is supplied to the retard chambers 208 of the exhaust VVT 33 and the vane body 202 pivots in the retarding direction, and oil discharged from the advance chambers 207 with volume reduction of the advance chambers 207 is drained from the output port 352 to the oil pan 6 through a drain port 358.

As described above, the exhaust-side oil pressure control valve 35 controls oil supply to the advance chambers 207 and the retard chambers 208 of the exhaust VVT 33 so that opening and closing timings of the exhaust side can be changed. Specifically, when oil is supplied in a larger amount (under a higher oil pressure) to the advance chambers 207 than to the retard chambers 208, the exhaust cam shaft 19 pivots in the rotation direction of the cam shaft 19 (direction indicated by arrows in FIGS. 5 and 6) with respect to the housing 201, and the opening timing in the exhaust valve 15 is advanced. On the other hand, when oil is supplied in a larger amount (under a higher oil pressure) to the retard chambers 208 than to the advance chambers 207, the cam shaft 19 pivots in a direction opposite to the rotation direction of the cam shaft 19, and the opening timing of the exhaust valve 15 is retarded (see FIG. 5).

Configuration of Intake VVT 32

Figure 8:
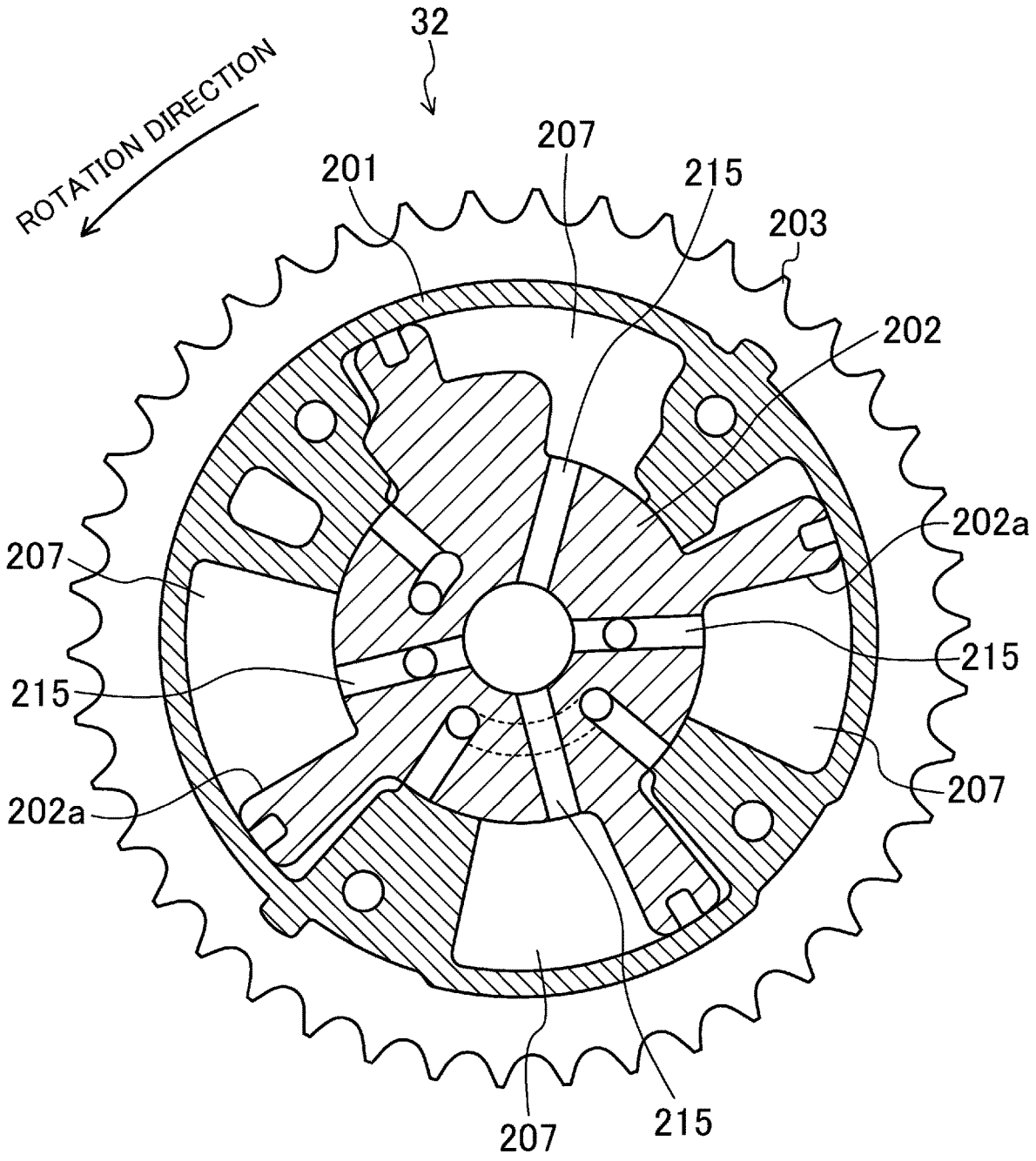
FIG. 8 A lateral cross-sectional view of the intake VVT in a most advanced state.
Figure 9:
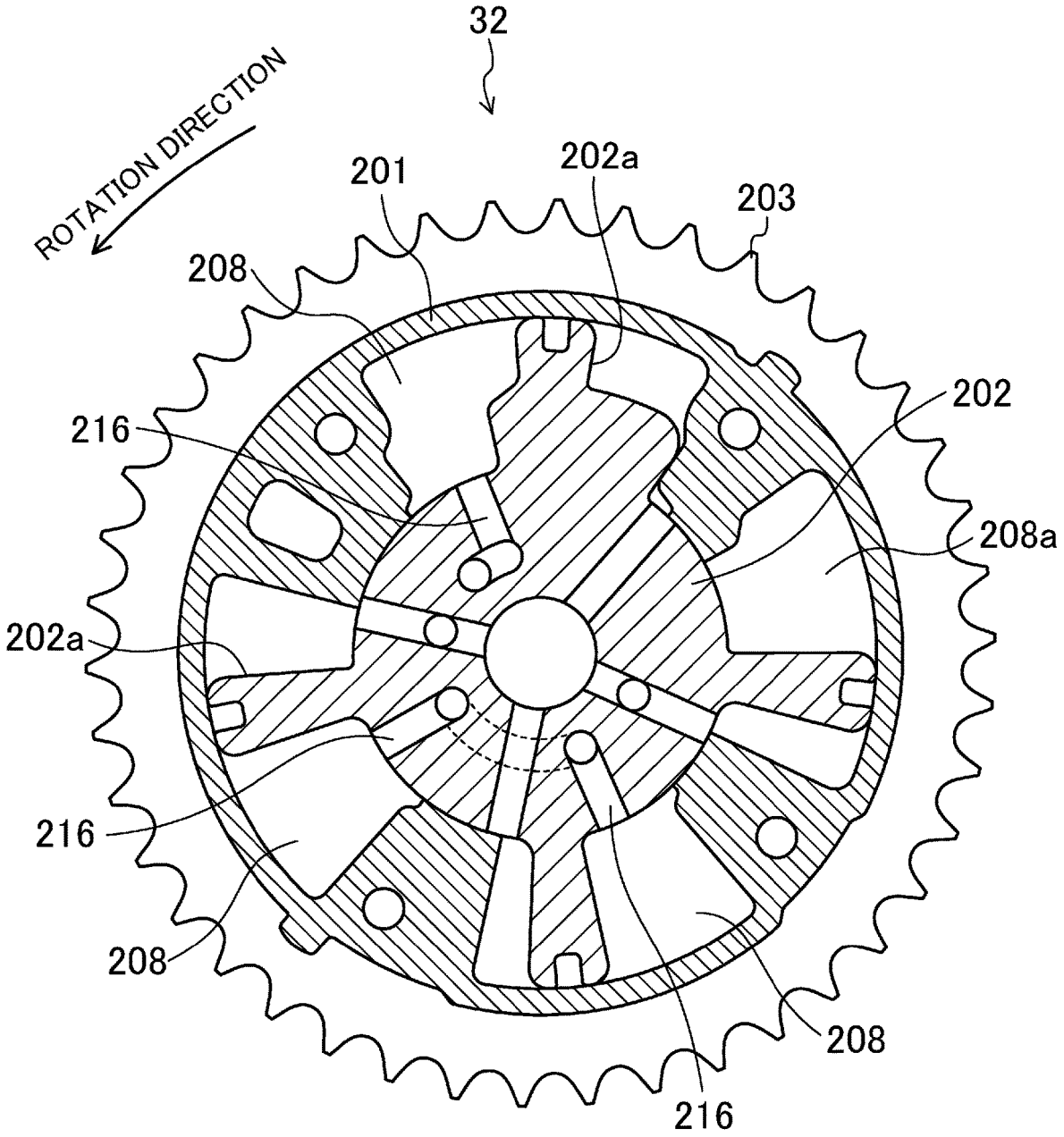
FIG. 9 A lateral cross-sectional view of the intake VVT in a most retarded state.

FIGS. 8 and 9 illustrate the intake VVT 32. The intake VVT 32 employs a hydraulic VVT having the same configuration as that of the exhaust VVT 33. In this case, since the intake VVT 32 and the exhaust VVT 33 rotate in opposite directions as described above, elements constitutes the advance chambers 207 of the exhaust VVT 33 serve as the retard chambers 208 in the intake VVT 32, and elements constituting the retard chambers 208 of the exhaust VVT 33 serve as the advance chambers 207 in the intake VVT 32. Similarly, elements constituting the advance-side oil passages 215 of the exhaust VVT 33 serve as the retard-side oil passages 216 in the intake VVT 32, and elements constituting the retard-side oil passages 216 of the exhaust VVT 33 serve as the advance-side oil passages 215 in the intake VVT 32.

Thus, in the intake VVT 32, the number of advance chambers 207 is four, and the number of the retard chambers 208 is three. The intake VVT 32 is connected to an intake-side oil pressure control valve (first direction switching valve) 34 illustrated in FIG. 10. The intake-side oil pressure control valve 34 is a solenoid valve having three ports and three positions similar to the exhaust-side oil pressure control valve 35. Although not shown specifically, in the intake-side oil pressure control valve 34, a port corresponding to the output port 352 of the exhaust-side oil pressure control valve 35 illustrated in FIG. 7 serves as a retarding output port, and a port corresponding to the output port 353 serves as an advancing output port.

Oil Supply Device

Figure 10:
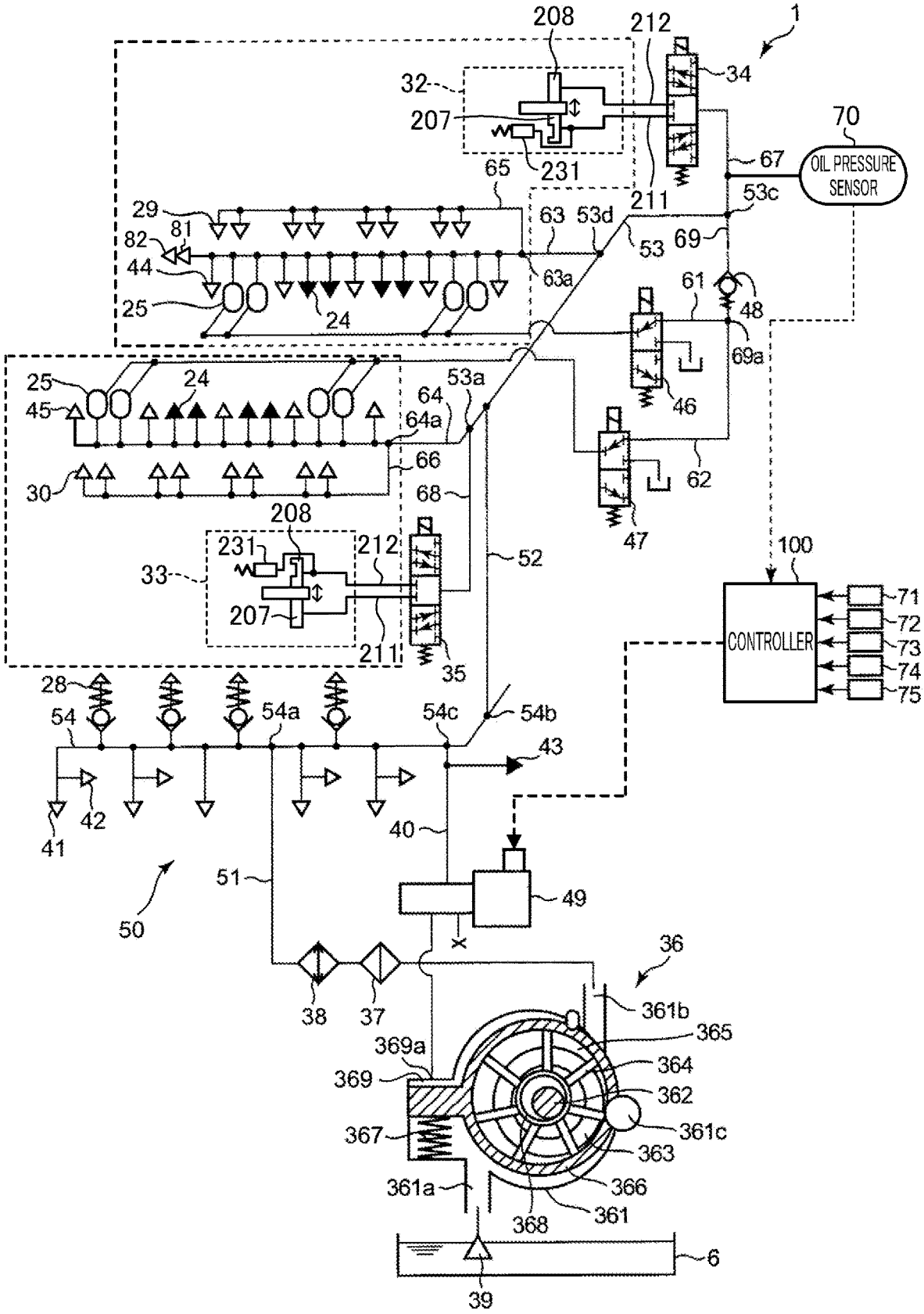
FIG. 10 A view illustrating an engine oil supply system.

As illustrated in FIG. 10, an oil supply device 1 that supplies oil to the engine 2 includes a variable displacement oil pump 36 that is driven by rotation of the crank shaft 9, and an oil supply passage 50 (oil supply path) that is connected to the oil pump 36 and guides oil whose pressure has been increased by the oil pump 36 to a lubricating part of the engine 2 and the hydraulic operating devices such as the exhaust VVT 33.

The oil supply passage 50 is constituted by a first communication path 51, a main gallery 54, a second communication path 52, a third communication path 53, and a plurality of oil passages 61 through 69.

The first communication path 51 extends from an outlet 361*b* of the oil pump 36 to a branch point 54*a* in the cylinder block 5. The main gallery 54 extends along the cylinder line in the cylinder block 5. The second communication path 52 extends from a branch point 54*b* on the main gallery 54 to the cylinder head 4. The third communication path 53 extends substantially horizontally between an intake side and an exhaust side in the cylinder head 4. The plurality of oil passages 61 through 69 are branched from the third communication path 53 in the cylinder head 4.

The oil pump 36 includes a housing 361, a driving shaft 362, a pump element, a cam ring 366, a spring 367, and ring members 368.

The housing 361 is constituted by a pump body having an opening at one end and including a pump accommodating chamber including a hollow space that is circular in cross section, and a cover member covering the opening at the end of the pump body. The driving shaft 362 is rotatably supported by the housing 361, penetrates substantially a center portion of the pump accommodating chamber, and is driven to rotate by the crank shaft 9. The pump element is constituted by a rotor 363 rotatably housed in the pump accommodating chamber and coupled to the driving shaft 362 at a center portion thereof, and vanes 364 individually retreatably housed in a plurality of slits formed by radially cutting out an outer peripheral portion of the rotor 363. The cam ring 366 is eccentrically disposed with respect to a rotation center of the rotor 363 at the outer periphery of the pump element, and defines pump chambers 365 as a plurality of hydraulic oil chambers together with the rotor 363 and its adjacent vanes 364. The spring 367 is a biasing member that is housed in the pump body and constantly biases the cam ring 366 in a direction in which an eccentricity of the cam ring 366 with respect to the rotation center of the rotor 363 increases. The ring members 368 are a pair of ring-shaped members slidably disposed at each inner peripheral side of the rotor 363 and each having a smaller diameter than the rotor 363.

The housing 361 includes an inlet 361*a* through which oil is supplied to inner pump chambers 365 and the outlet 361*b* through which oil is discharged from the pump chambers 365. In the housing 361, a pressure chamber 369 is defined by the inner peripheral surface of the housing 361 and the outer peripheral surface of the cam ring 366, and the pressure chamber 369 has an introduction hole 369*a*.

As described above, the oil pump 36 is configured such that introduction of oil into the pressure chamber 369 through the introduction hole 369*a* causes the cam ring 366 to swing with respect to a fulcrum 361*c* and causes the rotor 363 to be eccentric with respect to the cam ring 366 so that the discharge capacity of the oil pump 36 changes.

An oil strainer 39 facing the oil pan 6 is connected to the inlet 361*a* of the oil pump 36. In the first communication path 51 communicating with the outlet 361*b* of the oil pump 36, an oil filter 37 and an oil cooler 38 are disposed in this order from an upstream side to a downstream side. Oil stored in the oil pan 6 is pumped by the oil pump 36 through the oil strainer 39, then filtered by the oil filter 37 and cooled by the oil cooler 38, and then introduced to the main gallery 54 in the cylinder block 5.

The main gallery 54 is connected to the oil jet 28 for injecting cooling oil to the back surfaces of the four pistons 8 described above, oil supply portions 41 of metal bearings disposed in five main journals rotatably supporting the crank shaft 9, and oil supply portions 42 of metal bearings disposed on crank pins of the crank shaft 9 rotatably coupling four connecting rods. Oil is constantly supplied to the main gallery 54.

An oil supply portion 43 for supplying oil to a hydraulic chain tensioner and an oil passage 40 for supplying oil from the introduction hole 369*a* into the pressure chamber 369 of the oil pump 36 through a linear solenoid valve 49 are connected to a downstream side of a branch point 54*c* on the main gallery 54.

An oil supply system at the exhaust valve side will be described. An oil passage 68 branching from a branch point 53*a* of the third communication path 53 is connected to the oil pressure control valve 35 of the exhaust VVT 33. An oil passage 64 branching from the branch point 53*a* is connected to oil supply portions 45 (see white triangles in FIG. 10), the HLAs 24 (see black triangles in FIG. 10), and valve stop mechanism-equipped HLAs 25 (white oval in FIG. 10). The oil supply portions 45 supply oil to a cam journal of the exhaust-side cam shaft 19. The oil passage 64 is constantly supplied with oil. In addition, an oil passage 66 branching from a branch point 64*a* of the oil passage 64 is connected to the oil shower 30 that supplies lubricating oil to an exhaust-side swing arm 21. The oil passage 66 is also constantly supplied with oil.

Next, an oil supply system at the intake valve side will be described. An oil passage 67 branching from a branch point 53*c* of the third communication path 53 is connected to the intake-side oil pressure control valve 34. The intake-side oil pressure control valve 34 is controlled such that oil is supplied to the advance chambers 207 and the retard chambers 208 of the intake VVT 32 through an advance-side oil passage 211 and a retard-side oil passage 212, respectively. The oil passage 67 is provided with an oil pressure sensor 70 that detects an oil pressure of the oil passage 67. The oil passage 63 branching from a branch point 53*d* is connected to oil supply portions 44 of a cam journal of the intake cam shaft 18 (see white triangles in FIG. 10), the HLAs 24 (see black triangles in FIG. 10), the valve stop mechanism-equipped HLAs 25 (see white ovals in FIG. 10), the fuel pump 81, and a vacuum pump 82. The vacuum pump 82 is driven by the cam shaft 18, and obtains a pressure of a brake master cylinder. In addition, an oil passage 65 branching from a branch point 63*a* of the oil passage 63 is connected to the oil shower 29 that supplies lubricating oil to the intake-side swing arm 20.

The oil passage 69 branching from a branch point 53*c* of the third communication path 53 is provided with a check valve 48 that restricts an oil flow direction to one direction from an upstream side to a downstream side. At a branch point 69*a* downstream of the check valve 48, the oil passage 69 branches to the two oil passages 61 and 62 communicating with the attachment holes 26 and 27 for the valve stop mechanism-equipped HLAs 25. The oil passages 61 and 62 are connected to the valve stop mechanisms 25*b* of the intake-side and exhaust-side valve stop mechanism-equipped HLAs 25 at the intake side and the exhaust side through an intake-side second direction switching valve 46 and an exhaust-side second direction switching valve 47, respectively. In this configuration, the intake- and exhaust-side second direction switching valves 46 and 47 are controlled to supply oil to the valve stop mechanisms 25*b*.

After lubrication and cooling, lubricating oil and cooling oil supplied to the metal bearing rotatably supporting the crank shaft 9, the pistons 8, and the cam shafts 18 and 19, for example, are dropped in the oil pan 6 through an unillustrated drain oil passage and is circulated by the oil pump 36 again.

Control System

An operation of the engine 2 is controlled by a controller 100. The controller 100 receives detection information from sensors that detect an operating state of the engine 2. The controller 100 detects a rotation angle of the crank shaft 9 by a crank angle sensor 71 and determines an engine speed based on the detection signal, for example. An action position sensor 72 detects a pressing amount (accelerator opening angle) of an accelerator pedal by a passenger of the vehicle on which the engine 2 is mounted. Based on the pressing amount, a required torque is calculated. In addition, the oil pressure sensor 70 detects a pressure of the oil passage 67. An oil temperature sensor 73 disposed substantially at the same position as the oil pressure sensor 70 detects an oil temperature in the oil passage 67. The oil pressure sensor 70 and the oil temperature sensor 73 may be disposed on any location of the oil supply passage 50. The cam angle sensor 74 causes the oil pressure control valves 31 and 35 of the VVTs 32 and 33 to operate such that the detected phase angles of the VVTs 32 and 33 reach target phase angles set in accordance with the operating state of the engine, based on detected current phase angles of the VVTs 32 and 33. A water temperature sensor 75 detects a temperature of cooling water for cooling the engine 2 (hereinafter referred to as a water temperature).

The controller 100 is a control device based on a known microcomputer, and includes a signal receiving section that receives detection signals from sensors (e.g., the oil pressure sensor 70, the crank angle sensor 71, a throttle position sensor 72, the oil temperature sensor 73, the cam angle sensor 74, and the water temperature sensor 75), a computation section that performs a computation process for control, a signal output section that outputs control signals to devices to be controlled (e.g., the oil pressure control valves 35, 46, and 47 and the linear solenoid valve 49), and a storage section that stores programs and data necessary for control (e.g., an oil pressure control map and a duty ratio map).

The linear solenoid valve 49 is a flow rate (discharge rate) control valve for controlling the discharge rate of the oil pump 36 in accordance with the operating state of the engine 2. In this configuration, oil is supplied to the pressure chamber 369 of the oil pump 36 while the linear solenoid valve 49 is open. The configuration of the linear solenoid valve 49 itself is already known, and thus, will not be described here.

The controller 100 transmits, to the linear solenoid valve 49, a control signal of a duty ratio in accordance with the operating state of the engine 2, and controls a pressure of oil to be supplied to the pressure chamber 369 of the oil pump 36 through the linear solenoid valve 49. Based on the oil pressure of the pressure chamber 369, an eccentricity of the cam ring 366 is controlled so that the amount of change of the internal volume of the pump chambers 365 is controlled to thereby control the flow rate (discharge rate) of the oil pump 36. That is, the volume of the oil pump 36 is controlled by using the duty ratio.

Control of VVTs 32 and 33

Figure 11:
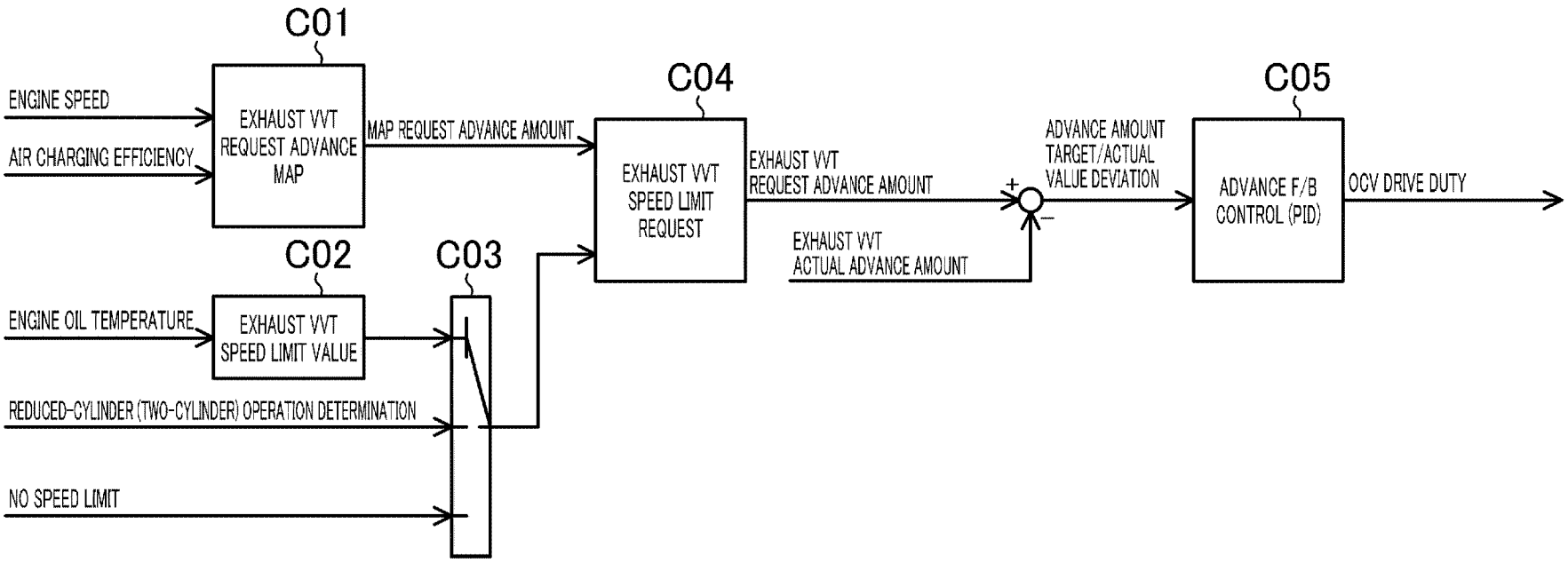
FIG. 11 A control block diagram of the exhaust VVT.

FIG. 11 is a block diagram illustrating a method for controlling the exhaust VVT 33. From an exhaust VVT request advance map C01 set in an engine operating state (an engine speed and an air charging efficiency), a request advance amount of the exhaust VVT 33 is acquired in accordance with the engine operating state. The acquired map request advance amount is input to an exhaust VVT speed limit request block C04.

In a block C02, a limit value of an operating speed of the exhaust VVT 33 is acquired based on an engine oil temperature. Oil temperature-speed limit tables are previously created for a reduced-cylinder operation and an all-cylinder operation individually, and the limit value of the operating speed of the exhaust VVT 33 is acquired from these tables.

The speed limit value acquired from each table is input to a switch block C03. The switch block C03 receives "reduced-cylinder operation determination" in a reduced-cylinder operation and "no speed limit" for maintaining valve stop in an all-cylinder operation, in addition to the speed limit value from each table. In the reduced-cylinder operation, the speed limit value acquired from the oil temperature-speed limit table for the reduced-cylinder operation is input to the exhaust VVT speed limitation request block C04. In the all-cylinder operation, the speed limit value acquired from the oil temperature-speed limit table for the all-cylinder operation is input to the exhaust VVT speed limitation request block C04.

The exhaust VVT speed limitation request block C04 outputs an exhaust VVT request advance amount. A difference between this exhaust VVT request advance amount and a current exhaust VVT actual advance amount is calculated. From this difference, a deviation between a request value (target value) of an advance amount and an actual advance amount is calculated, and is input to an advance F/B control block C05.

In the advance F/B control block C05, based on the input advance amount target/actual value deviation, an OCV drive duty ratio in accordance with the limit value of the operating speed of the exhaust VVT 33 is obtained by, for example, a proportional-integral-differential (PID) method.

Although not shown, the method for controlling the intake VVT 32 is similar to that for the exhaust VVT 33, and an operation of the intake VVT 32 is controlled by using an intake VVT request advance map set in accordance with the engine operating state (the engine speed and the air charging efficiency), and oil temperature-speed limit tables set for a reduced-cylinder operation and an all-cylinder operation individually in accordance with the engine oil temperature.

Example of Valve Timing Change

Figure 12:
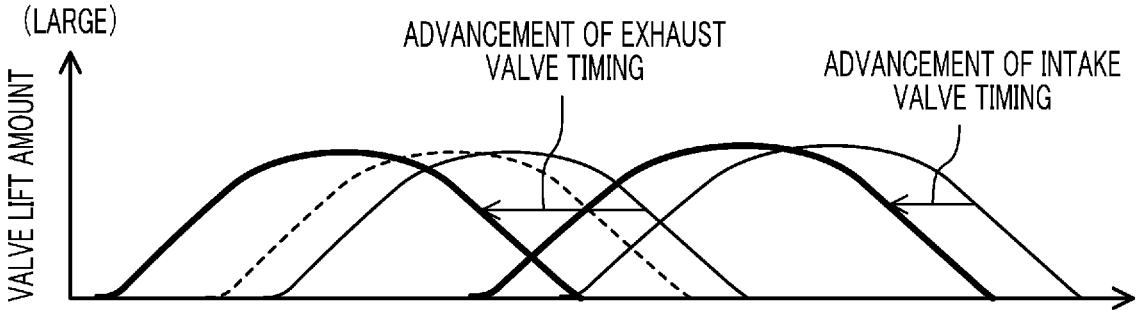
FIG. 12 A graph showing an example of changes of opening and closing timings at which a valve overlap amount changes from a large state to a small state.

FIG. 12 shows changes of opening and closing timings of the intake and exhaust valves 14 and 15 set based on the VVT request advance map when the engine 2 shifts from an intermediate-rotation and intermediate-load operating state to a low-rotation and low-load operating state. In FIG. 12, thin solid lines indicate opening and closing timings before shift, and bold solid lines indicate opening and closing timings after the shift. This is a case where the opening and closing timings of the intake and exhaust valves 14 and 15 are advanced, and an operating state with a large valve overlap amount shifts to an operating state with a small valve overlap amount.

As described above, the number of advance chambers 207 is "four" and the number of retard chambers 208 is "three" in the intake VVT 32, whereas the number of advance chambers 207 is "three" and the number of retard chambers 208 is "four" in the exhaust VVT 33 That is, the number of advance chambers 207 in the intake VVT 32 is larger than that in the exhaust VVT 33. Thus, when oil pressures applied to the VVTs 32 and 33 are the same, the advancing speed of the opening/closing timing of the intake valve 14 is higher than the advancing speed of the opening/closing timing of the exhaust valve 15.

Thus, in operating the VVTs 32 and 33 at the same time, as shown in FIG. 12, when the opening/closing timing of the exhaust valve 15 is only slightly advanced from a position indicated by the thin solid line to a position indicated by a broken line, for example, the opening/closing timing of the intake valve 14 is greatly advanced from a position indicated by the thin solid line to a position indicated by a bold solid line. Accordingly, in a transition period in which the valve overlap amount shifts from a large state to a small state, the state with a relatively large valve overlap amount continues for a while (where the valve overlap amount can be temporarily increased). As a result, an increase in a pumping loss can be suppressed in this transition period so that fuel efficiency can be enhanced.

Figure 13:
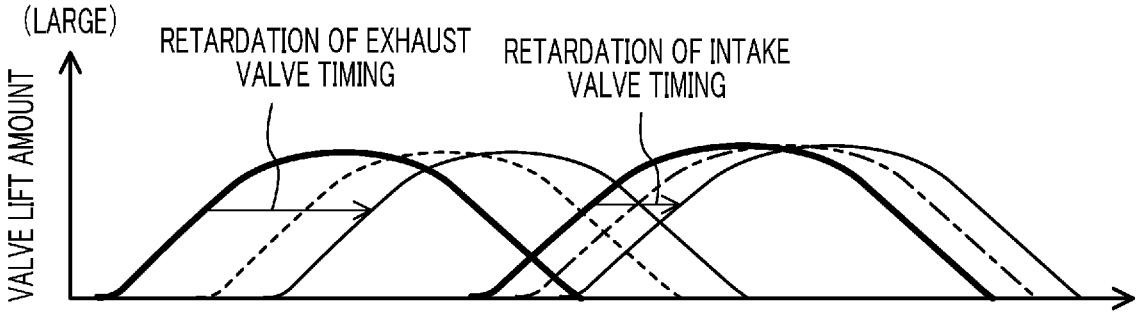
FIG. 13 A graph showing an example of changes of opening and closing timings at which the valve overlap amount changes from a small state to a large state.

FIG. 13 shows changes of the opening and closing timings of the intake and exhaust valves 14 and 15 set based on the VVT request advance map when the engine 2 shifts from a low-rotation and low-load operating state to an intermediate-rotation and intermediate-load operating state. In FIG. 12, thin solid lines indicate opening and closing timings before shift, and bold solid lines indicate opening and closing timings after the shift. This is a case where the opening and closing timings of the intake and exhaust valves 14 and 15 are retarded, and an operating state with a small valve overlap amount shifts to an operating state with a large valve overlap amount.

Since the number of retard chambers 208 in the exhaust VVT 33 is larger than that in the intake VVT 32 as described above, oil pressures applied to the VVTs 32 and 33 are the same, the retarding speed of the opening/closing timing of the exhaust valve 15 is higher than the retarding speed of the opening/closing timing of the intake valve 14.

Thus, in operating the VVTs 32 and 33 at the same time, as shown in FIG. 13, when the opening/closing timing of the intake valve 14 is only slightly retarded from a position indicated by the thin solid line to a position indicated by a chain line, for example, the opening/closing timing of the exhaust valve 15 is greatly retarded from a position indicated by a thin solid line to a position indicated by a broken line. Accordingly, in a transition period in which the valve overlap amount shifts from a small state to a large state, the valve overlap amount increases quickly. As a result, a pumping loss can be reduced so that fuel efficiency can be enhanced.

As described above, in a situation where oil pressures that can be used by the intake VVT 32 and the exhaust VVT 33 are restricted and the operating speeds of the VVTs 32 and 33 are limited, a pumping loss in a transition period in which the valve overlap amount is changed by advancing or retarding the opening/closing timing can be reduced, which is advantageous for enhancing fuel efficiency.

In this embodiment, although the number of advance chambers is smaller than the number of retard chambers in the exhaust VVT 33, since the number of advance chambers is larger than the number of retard chambers in the intake VVT 32, the intake cam shaft 18 has a margin for a rotation load in the advancing direction as compared to the exhaust cam shaft 19. The embodiment uses this configuration to perform cam driving of the fuel pump 105 by using the intake cam shaft 18. Thus, the fuel pump 105 can be easily operated with stability without hindering a change of opening and closing of the intake valve 14 and the timings of opening and closing the intake valve 14. In addition, the fuel pump 105 can be easily disposed at the intake side of the engine 2, which is advantageous in safety.

In this embodiment, the number of advance chambers is larger than that of retard chambers in the intake VVT 32 and the number of retard chambers is larger than that of advance chambers in the exhaust VVT 33. Alternatively, if the number of advance chambers is larger than that of retard chambers in the intake VVT 32, the number of retard chambers may be equal to that of advance chambers in the exhaust VVT 33. If the number of retard chambers is larger than that of advance chambers in the exhaust VVT 33, the number of advance chambers may be equal to that of retard chambers in the intake VVT 32.

DESCRIPTION OF REFERENCE CHARACTERS

1 oil supply device
2 engine
8 piston
14 intake valve
15 exhaust valve
18 intake cam shaft
19 exhaust cam shaft
25 valve stop mechanism-equipped HLA
25*a* pivot mechanism
25*b* valve stop mechanism
28 oil jet
32 intake VVT
33 exhaust VVT
34 oil pressure control valve
35 oil pressure control valve
36 oil pump
207 advance chamber
208 retard chamber

The invention claimed is:

1. An engine with a variable valve timing mechanism, the engine comprising:

an intake VVT serving as a variable valve timing mechanism that changes a phase angle of an intake cam shaft with respect to a crank shaft and;

an exhaust VVT serving as a variable valve timing mechanism that changes a phase angle of an exhaust cam shaft with respect to the crank shaft, wherein each of the intake VVT and the exhaust VVT is a hydraulic VVT including advance chambers for changing the phase angle in an advancing direction by supply of an oil pressure and retard chambers for changing the phase angle in a retarding direction by supply of an oil pressure, each of the advance chambers and the retard chambers is defined by a housing configured to rotate in cooperation with the crank shaft and a vane body configured to rotate together with the cam shaft, and the number of the advance chambers is larger than or equal to the number of the retard chambers in the intake VVT and the number of the retard chambers is larger than or equal to the number of the advance chambers in the exhaust VVT or the number of the advance chambers is larger than the number of the retard chambers in the intake VVT and the number of the retard chambers is larger than or equal to the number of the advance chambers in the exhaust VVT.

2. The engine according to claim 1, further comprising a transfer unit that drives the housing of the intake VVT and the housing of the exhaust VVT such that the housing of the intake VVT and the housing of the exhaust VVT rotate in opposite direction by the crank shaft, wherein the number of the advance chambers in the intake VVT is equal to the number of the retard chambers in the exhaust VVT, and the number of the retard chambers in the intake VVT is equal to the number of the advance chambers in the exhaust VVT.

3. The engine according to claim 1, further comprising a high-pressure fuel pump that serves as an auxiliary machine of the engine and supplies fuel to a combustion chamber of the engine, wherein the number of the advance chambers is larger than the number of the retard chambers in the intake VVT, and the intake cam shaft includes a cam portion that drives the fuel pump.

4. The engine according to claim 2, further comprising a high-pressure fuel pump that serves as an auxiliary machine of the engine and supplies fuel to a combustion chamber of the engine, wherein the number of the advance chambers is larger than the number of the retard chambers in the intake VVT, and the intake cam shaft includes a cam portion that drives the fuel pump.

* * * * *